US006257961B1

(12) United States Patent
Suzuki et al.

(10) Patent No.: US 6,257,961 B1
(45) Date of Patent: Jul. 10, 2001

(54) ROTATIONAL SPEED ADJUSTMENT FOR WAFER POLISHING METHOD

(75) Inventors: Yoshinori Suzuki, Vancouver, WA (US); James O. Bopp, Newark, DE (US)

(73) Assignee: SEH America, Inc., Vancouver, WA (US)

( * ) Notice: Subject to any disclaimer, the term of this patent is extended or adjusted under 35 U.S.C. 154(b) by 0 days.

(21) Appl. No.: 09/503,914

(22) Filed: Feb. 15, 2000

(51) Int. Cl.[7] ..... B24B 1/00

(52) U.S. Cl. ..... 451/41; 451/5; 451/8; 451/285

(58) Field of Search ..... 451/41, 5, 8, 285, 451/9, 10, 63, 287, 259, 268, 269, 397, 398

(56) References Cited

U.S. PATENT DOCUMENTS 4,356,669 * 11/1982 Hoglund ..... 451/239
4,438,598 * 3/1984 Wohlmuth ..... 451/5
4,450,652 5/1984 Walsh .
5,433,650 * 7/1995 Winebarger ..... 451/41
5,895,270 * 4/1999 Hempel, Jr. ..... 451/41
5,914,053 6/1999 Masumura et al. .
5,951,374 9/1999 Kato et al. .
5,975,991 * 11/1999 Karlsrud ..... 451/41
6,113,465 * 9/2000 Kim et al. ..... 451/41

* cited by examiner

*Primary Examiner*—Derris H. Banks
*Assistant Examiner*—Hadi Shakeri
(74) *Attorney, Agent, or Firm*—Oliff & Berridge, PLC

(57) ABSTRACT

A method of obtaining polished semiconductor wafers with a polishing device includes conducting polishing of a first batch of semiconductor wafers with the polishing device at a turntable rotational speed to obtain a first batch of polished semiconductor wafers, experiencing a downtime following completion of the polishing of the first batch of semiconductor wafers with the polishing device, adjusting the turntable rotational speed for polishing of a next consecutive batch of semiconductor wafers, the adjustment being based upon a length of the downtime between the completion of the polishing of the first batch of semiconductor wafers and a start of polishing of the next consecutive batch of semiconductor wafers, and conducting polishing of the next consecutive batch of semiconductor wafers with the polishing device at the adjusted turntable rotational speed to obtain a next consecutive batch of semiconductor wafers. The method insures that batches of wafers polished after a downtime of the polishing device have a necessary flatness.

13 Claims, No Drawings

ROTATIONAL SPEED ADJUSTMENT FOR WAFER POLISHING METHOD

BACKGROUND OF THE INVENTION

1. Field of Invention

This invention relates to a method of polishing a semiconductor wafer. More in particular, this invention to a method of adjusting the rotational speed of a turntable of a wafer polishing device for different batches of semiconductor wafers to be polished in order to consistently obtain polished wafers having excellent flatness.

2. Description of Related Art

One of the final steps in a conventional semiconductor wafer shaping process is a polishing step to produce a highly reflective and damage-free surface on one face or both faces of the semiconductor wafer. Polishing of the semiconductor wafer is most typically accomplished by the well-known mechanochemical process in which a rotating polishing pad rubs a polishing slurry against the wafer. In a conventional semiconductor wafer polishing device, wafers to be polished are mounted upon a turntable that rotates the wafers. The wafers upon the turntable and the polishing pad are brought into contact in order to effect polishing of the wafers.

Semiconductors wafers must be polished particularly flat in preparation for the formation of circuits on the wafers by well known procedures. Flatness of the wafer surface on which circuits are to be printed is critical in order to maintain resolution of the lines, which can be as thin as 1 micron or less.

Flatness of a wafer is quantified in part by a total thickness variation (TTV) measurement. TTV is defined as the difference between the maximum and the minimum thicknesses of the wafer. Total thickness variation in the wafer is a critical indicator of the quality of the polish of the wafer.

In conventional wafer polishing, some of the frictional heat generated by the rubbing action of the wafer, polishing pad and slurry is transferred to the polishing block and the polishing turntable. This heat transfer induces temperature gradients through the polishing block and turntable which cause thermal expansion of the polishing block and turntable. The thermal expansion adversely affects the flatness of the polishing block and turntable and therefore adversely affects the flatness of polished wafers obtained, particularly if the thermal expansion is uncontrolled and varies from different batches of wafers to be polished by the polishing device.

For example, in the idle time between polishing cycles, the induced distortion in the turntable begins to dissipate as its temperature equalizes. If this idle time varies, successively polished wafers may show significant flatness variations. This is particularly problematic with respect to occasional periods of downtime that occur with a particular polishing device.

Procedures for dealing with the restarting of the polishing device after a downtime period in order to continue to derive polished wafers having suitable flatness have included adjusting the pressure used in the polishing in order to offset the temperature induced distortions. However, this method requires precise control of the pressure adjustments and is not always successful in achieving wafers having suitable flatness, resulting in loss of wafers. Another procedure has included running several dummy polishing runs after restart with dummy wafers until the polishing device has returned to a steady state operation. However, this method is time consuming and costly.

U.S. Pat. No. 4,450,652 relates to a wafer workpiece polishing temperature control method and apparatus. Wafers are mounted upon a rotatable pressure plate assembly positioned in rotatable contact with a turntable assembly supported polishing pad, the turntable assembly having internal fluid cooling means, the wafer polishing temperature control being achieved through responsive closed loop electromechanical means activated by variation of polishing pressure upon the wafers and the polishing pad. In particular, the method controls the thermal bow distortion of a hollow internally cooled turntable having a polishing pad mounted on the top surface during polishing of semiconductor wafers held in pressurized rotatable contact with the polishing pad by circulating a heat transfer fluid through the turntable to maintain the bottom surface of the turntable at a constant temperature, sensing the temperature of said polishing pad, and regulating the pressure of the wafer against the polishing pad in response to said sensed temperature to maintain the polishing pad and top surface of the turntable at a constant temperature, whereby the temperature differential between the top and bottom surfaces of the turntable is maintained constant thereby maintaining the thermal bow distortion of the turntable constant.

What is sought, then, is a simpler and more cost effective method for assuring that wafers polished in a polishing device after a period of downtime exhibit a desired flatness.

SUMMARY OF THE INVENTION

It is thus one object of the present invention to develop a method of polishing semiconductor wafers in which the wafers polished immediately following a period of downtime of the polishing device posses a desired high degree of flatness.

It is still a further object of the present invention to develop a method of polishing semiconductor wafers as stated above, which method is capable of automation.

It is a still further object of the present invention to develop a method of polishing semiconductor wafers as stated above which can be practiced simply and easily within the context of large scale, mass production of polished semiconductor wafers.

These and other objects of the present invention are achieved by the present invention, which in one aspect is a method of obtaining polished semiconductor wafers with a polishing device, comprising conducting polishing of a first batch of semiconductor wafers with the polishing device at a turntable rotational speed to obtain a first batch of polished semiconductor wafers, experiencing a downtime following completion of the polishing of the first batch of semiconductor wafers with the polishing device, adjusting the turntable rotational speed for polishing of a next consecutive batch of semiconductor wafers, the adjustment being based upon a length of the downtime between the completion of the polishing of the first batch of semiconductor wafers and a start of polishing of the next consecutive batch of semiconductor wafers, and conducting polishing of the next consecutive batch of semiconductor wafers with the polishing device at the adjusted turntable rotational speed to obtain a next consecutive batch of semiconductor wafers.

These and other objects of the present invention are also achieved by the present invention, which in a further aspect is a method of polishing semiconductor wafers, comprising: determining turntable rotational speed adjustment data for a polishing device associated with various downtime periods between completion of polishing of a batch of semiconductor wafers and a start of polishing of a next consecutive batch of semiconductor wafers, the turntable rotational speed adjustment data comprising turntable rotational speed adjustments that maintain a desired flatness of semiconductor wafers from consecutive batches; following completion of polishing of a batch of semiconductor wafers with the polishing device at a standard turntable rotational speed for the polishing device, experiencing a downtime period; determining a length of the downtime period until a start of polishing of a next consecutive batch of semiconductor wafers with the polishing device; adjusting the turntable rotational speed in accordance with the turntable rotational speed adjustment data for the polishing device for the downtime determined; and conducting polishing of the next consecutive batch of semiconductor wafers at the adjusted turntable rotational speed.

The present method thus attains a method capable of easily maintaining a high degree of flatness for wafers polished in different batches with the same polishing device, even when a downtime period of operation occurs between batches.

DETAILED DESCRIPTION OF PREFERRED EMBODIMENTS

The polishing device used in the present invention may be any conventional device known in the art which contains a rotating turntable which rotates in carrying out the polishing procedure. The polishing device may be, for example, a single-side polisher or a double-side polisher, both of which are known in the art. See, for example, U.S. Pat. No. 4,450,652 for a single-side polishing device and U.S. Pat. Nos. 5,951,374 and 5,914,053 for a double-side polishing device. These references are incorporated by reference herein in their entireties.

For example, single-side current chemical-mechanical polishing processes for silicon and other semiconductor wafers may be carried out on a polishing device in which a batch of semiconductor wafers are mounted upon a carrier through a mounting medium. A batch of wafers typically includes, for example, 4 to 10 wafers. The mounting medium may be either a wax or any of several waxless mounting media, such as a vacuum, which provide means for adhering the wafers to the carrier. The carrier is preferably mounted through a resilient pressure pad, for example an air bag, to a pressure plate which, in turn, is suitably mounted to elements capable of rotation. Opposite the surface of the carrier upon which the wafers are mounted, a polishing pad is mounted upon a turntable. During polishing, the turntable is rotated and brought into contact with the wafers at a pressure that may be modified with the air bag pressure or the contact force. When the polishing pad and wafers are in rotatable contact during polishing, the turntable forces rotation of the carrier through friction means, or the carrier may be rotated via independent drive means. Temperature control, e.g., cooling, means may also be provided in association with the turntable in order to regulate the temperature of the polishing device environment.

For a given polishing device, the polishing rate may be set by the operator, and is dependent upon, among other factors, the speed of rotation of the turntable. Once the polishing device reaches a steady state of operation, i.e., that state at which the polishing conditions remain the same from batch to batch of semiconductor wafers, successive batches of semiconductor wafers may be polished with the device at the same turntable rotational speed, and all of the polished wafers from the batches exhibit a high degree of uniform flatness. In other words, the polishing device can be set to have a standard or base turntable rotation speed which can be maintained for consecutive batches of semiconductor wafers to be polished.

By standard or base turntable rotational speed, then, is meant that rotational speed of the turntable of a polishing device at which the polishing is being effected, which speed does not vary from batch to batch of semiconductor wafers when operating at steady state conditions. This standard or base rotational speed can be set by the operator of the polishing device taking into account the numerous factors of polishing, including the desired thickness of the polished wafers, the pressure of polishing, the life expectancy and/or present age of the polishing pad, and the temperature of polishing, among others. Once steady state operation of the polishing device is achieved, the standard or base turntable rotational speed preferably does not vary from batch to batch of semiconductor wafers.

Typically, the idle time between completion of the polishing of a batch of semiconductor wafers with the polishing device and the start of polishing of the next consecutive batch of semiconductor wafers is minimal, for example less than 5 minutes, and the polishing device can continue to be operated at the steady state conditions and the next batch of wafers polished possess the same excellent flatness. However, downtime periods between batches of semiconductor wafers occasionally occur during operation of the device. Such may occur as a result of mechanical problems with the device or for routine maintenance of the polishing device, for example the changing of the polishing pad.

As used herein, downtime periods are, for example, periods longer than the normal idle time between batches. For example, the downtime period from the completion of polishing of a first batch of semiconductor wafers to the start of polishing of the next consecutive batch of semiconductor wafers may be at least 5 minutes, including a period of from 5 minutes to 3 days. Longer periods of downtime may also occur within the scope of the invention, but such longer periods typically require complete shutdown of the polishing device.

When a period of downtime occurs, it has been found that the continued operation of the polishing device at the same steady state conditions prevailing prior to the downtime with the next batch or next several batches of semiconductor wafers to be polished following the downtime results in the polished wafers of such next batch or batches having unacceptably poor flatness.

The flatness desired for a polished semiconductor wafer is a total thickness variation (TTV) of 1.0 $\mu$m or less for each wafer. The flatness may also be indicated in terms of taper, outside taper referring to the wafer having an outer portion thicker than an inner portion, while inside taper refers to wafers having a greater thickness at an inner portion than at an outer portion. Here again, however, taper should be kept to 1.0 $\mu$m or less across the wafer surface. Wafers not meeting this flatness specification across the surface of the wafer must be discarded, or at least cannot be used with printed circuits.

It has now been found by the present inventors that merely by adjusting the rotational speed of a turntable upon which a polishing pad of the polishing device is mounted following a downtime period, the next batches of semiconductor wafers polished after the downtime can be polished to the desired high degree of flatness.

The adjustment of the turntable rotational speed that is needed, and the total number of adjustments needed, with batches of wafers following the downtime in order for the polishing process to continue to achieve polished wafers having the desired flatness is associated with the length of the period of downtime. Shorter downtimes require a lesser adjustment of the turntable rotational speed and also a fewer number of adjustments while longer downtimes require adjustments of the turntable rotational speed to be made to a greater extent.

As a downtime in polishing operations results in a temperature build-up in the turntable, and consequently an alteration in the turntable shape, the extent of this alteration increases as the downtime increases. Thus, the extent of the adjustments needed in order to compensate for these alterations increases as the downtime increases.

The initial adjustment of the turntable rotational speed following a downtime is a decrease in the rotational speed from the standard rotational speed of the turntable. Subsequent to this initial reduction in turntable rotational speed, the rotational speed is thereafter increased in polishing successive batches of wafers back up toward the standard rotational speed of the turntable prior to the downtime.

The number of total adjustments in rotational speed required before the turntable is returned to the standard rotational speed prior to the downtime varies, and is related to the length of the downtime as discussed above. With short downtimes, for example on the order of 5 to 15 minutes, as few as two total adjustments may be required—the first adjustment for the first batch of wafers polished after the downtime reducing the rotational speed, and the second adjustment with the next batch of wafers to be polished increasing the rotational speed back up to the standard rotational speed. Typically, however, several adjustments in the rotational speed will be required before the turntable rotational speed returns to the standard rotational speed, particularly for downtimes greater than, for example, 10 minutes in length.

For longer periods of downtime, the initial downward adjustment in rotational speed is most often larger than the initial adjustment with shorter downtimes, and the rotational speed typically must be gradually raised back up, through a number of successive batches of wafers, to the standard rotational speed. These subsequent adjustments, however, may not include an increase in rotational speed with each consecutive next batch of wafers. The turntable rotational speed may be the same for two or more of these subsequent batches before again being increased back up toward the standard rotational speed, and such is to be understood to still be within the scope of the subsequent adjustment of the turntable rotational speed as described herein.

The actual rpm adjustments for the turntable required varies depending upon several factors. For example, the actual rpm adjustment depends not only upon the extent of the downtime as discussed above, but also upon the standard rotational speed that the turntable is operated at. Thus, it is difficult to generalize the actual rpm adjustments needed since different polishing devices may operate at different rotational speeds. However, in general, the initial reduction in rotational speed following a downtime period may vary from, for example, 1 to 30 rpm. The rpm may thereafter be increased back up to the standard turntable rotational speed as discussed above.

In order for the adjustments to be made, the turntable rotational speed adjustment data is preferably stored in association with a controller that controls the polishing device and polishing operation. The turntable rotational speed adjustment data comprises the turntable rotational speed adjustments that are to be made for batches of wafers to be polished after the downtime based upon the length of the downtime. Thus, once the length of the downtime is determined, the controller can automatically make the necessary rotational speed adjustments of the turntable from the turntable rotational adjustment speed data.

While the rotational speed adjustment data may be generalized, i.e., stored as estimations, for a type of polishing device and the operating conditions of such device, in a most preferred embodiment of the invention the turntable rotational speed adjustment data for a particular polishing device is experimentally determined on that machine. In other words, for the most accurate data, it is most preferred to run trials upon the device at various downtimes to determine the optimal adjustments to be made, i.e., the adjustments that optimally maintain the flatness of all wafers in all batches following the downtime.

Once the rotational speed adjustment data is established, in order for the adjustments to be made, it is only necessary to determine the length of the downtime. With this information, the controller for the polishing device can automatically make the needed turntable rpm adjustments from the data.

Of course, it should be noted that the rotational speed adjustments can also be input by an operator for each batch of wafers to be polished. This may be particularly desirable where the operator recognizes that the adjustments from the data are for some reason not achieving polished wafers having the needed flatness.

Finally, it should be recognized that the lowering of the turntable rotational speed will result in a thicker wafer being obtained after polishing if the same polishing time is maintained. Thus, with the lowering of the rotational speed, the polishing time is also preferably lengthened in order to obtain a wafer not only having the desired flatness, but also having a similar thickness of other batches of wafers polished in the polishing device. The length of additional polishing time required may be from, for example, 10 seconds to 3 minutes, depending on the reduction in turntable rotational speed from the standard rotational speed, with greater reductions requiring longer polishing times to compensate. This data concerning the extension of polishing time can be included in the turntable rotational speed adjustment data and thus also automatically implemented by the controller.

The invention will now be further explained by way of the following example.

In this example, turntable rotational speed adjustment data is compiled for a conventional single-side polishing device of the type described above. The polishing device is operated at a standard turntable rotational speed of 33 rpm. The air bag pressure is 0.003 kg/cm$^2$. After operating at steady state conditions, various downtimes are introduced, and various adjustments in the turntable rotational speed are made for batches of wafers polished after the downtime. The downtimes and subsequent batch turntable rotational speed adjustments are summarized in Table 1.

TABLE 1

| Test Number | Shut down Time | Turntable rotation speed after shut down (rpm) | | | | |
|---|---|---|---|---|---|---|
| | | 1st Run | 2nd Run | 3rd Run | 4th Run | 5th Run |
| 1 | 10 min. | 33 | 33 | 33 | 33 | 33 |
| 2 | 10 min. | 31 | 33 | 33 | | |

TABLE 1-continued

| Test Number | Shut down Time | Turntable rotation speed after shut down (rpm) | | | | |
|---|---|---|---|---|---|---|
| | | 1st Run | 2nd Run | 3rd Run | 4th Run | 5th Run |
| 3 | 30 min. | 33 | 33 | 33 | 33 | |
| 4 | 30 min. | 29 | 31 | 33 | | |
| 5 | 60 min. | 33 | 33 | 33 | 33 | 33 |
| 6 | 60 min. | 29 | 31 | 33 | 33 | |
| 7 | 60 min. | 21 | 25 | 29 | 33 | 33 |

Following the polishing operation, the wafers from the batch are evaluated for using an ADE#7200E device and the results are averaged. The results are in Table 2 terms of taper, positive numbers being microns of inside taper and numbers being microns of outside taper.

TABLE 2

| Test Number | Average of wafer taper after shut down (μm) | | | | |
|---|---|---|---|---|---|
| | 1st Run | 2nd Run | 3rd Run | 4th Run | 5th Run |
| 1 | ~1.5 | <0.7 | −(<0.5) | <0.5 | |
| 2 | ~1.1 | <0.6 | −(<0.5) | | |
| 3 | ~2.1 | <0.8 | <0.5 | <0.5 | |
| 4 | <1.0 | <0.5 | <0.5 | | |
| 5 | ~2.5 | ~1.9 | <1.0 | −(<0.5) | <0.5 |
| 6 | ~2.0 | ~1.3 | <0.7 | <0.5 | |
| 7 | <0.6 | −(<0.5) | <0.5 | <0.5 | <0.5 |

From these results, it is evident that a downtime period of only 10 minutes can result in the next wafer batch polished after the downtime having unacceptable flatness (comparative test 1, first batch). It is also evident that greater adjustments are needed for longer downtimes, a downtime of 60 minutes requiring an initial turntable rotational speed reduction of 12 rpm from the standard (test 7, first batch). The turntable rotational speed adjustment data can be derived from the results of these tests.

What is claimed is:

1. A method of obtaining polished semiconductor wafers with a polishing device, the method comprising conducting polishing of a first batch of semiconductor wafers with the polishing device at a turntable rotational speed to obtain a first batch of polished semiconductor wafers, experiencing a downtime following completion of the polishing of the first batch of semiconductor wafers with the polishing device, adjusting the turntable rotational speed for polishing of a next consecutive batch of semiconductor wafers, the adjustment being based upon a length of the downtime between the completion of the polishing of the first batch of semiconductor wafers and a start of polishing of the next consecutive batch of semiconductor wafers, and conducting polishing of the next consecutive batch of semiconductor wafers with the polishing device at the adjusted turntable rotational speed to obtain a next consecutive batch of polished semiconductor wafers.

2. The method according to claim 1, wherein wafers of the first batch of polished semiconductor wafers and of the next consecutive batch of polished semiconductor wafers each have a total thickness variation of 1 μm or less.

3. The method according to claim 1, wherein the turntable rotational speed for polishing the first batch of semiconductor wafers is a standard turntable rotational speed for the polishing device.

4. The method according to claim 3, wherein the method further comprises, following completion of the polishing of the next consecutive batch of semiconductor wafers, further adjusting the turntable rotational speed for polishing an additional next consecutive batch of semiconductor wafers with the polishing device, and continuing such adjustment of the turntable rotational speed following completion of polishing of each next consecutive batch of semiconductor wafers until the turntable rotational speed is again the standard turntable rotational speed.

5. The method according to claim 3, wherein the turntable rotational speed adjustment for the next consecutive batch of semiconductor wafers comprises reducing the turntable rotational speed from the standard turntable rotational speed, and wherein subsequent turntable rotational speed adjustments for additional next consecutive batches of semiconductor wafers comprise increasing the turntable rotational speed from the reduced turntable rotational speed toward the standard turntable rotational speed.

6. The method according to claim 1, wherein the length of downtime is from 5 minutes to 3 days.

7. A method of polishing semiconductor wafers, the method comprising determining turntable rotational speed adjustment data for a polishing device associated with various downtime periods between completion of polishing of a batch of semiconductor wafers and a start of polishing of a next consecutive batch of semiconductor wafers, the turntable rotational speed adjustment data comprising turntable rotational speed adjustments that maintain a desired flatness of semiconductor wafers from consecutive batches, following completion of polishing of a batch of semiconductor wafers with the polishing device at a standard turntable rotational speed for the polishing device, experiencing a downtime period, determining a length of the downtime period until a start of polishing of a next consecutive batch of semiconductor wafers with the polishing device, adjusting the turntable rotational speed in accordance with the turntable rotational speed adjustment data for the polishing device for the downtime determined, and conducting polishing of the next consecutive batch of semiconductor wafers at the adjusted turntable rotational speed.

8. The method according to claim 7, wherein the desired flatness maintained by the turntable rotational speed adjustments comprises the wafers of the first batch of semiconductor wafers and of the next consecutive batch of semiconductor wafers each having a total thickness variation of 1 μm or less.

9. The method according to claim 7, wherein the adjustment comprises reducing the rotational speed of the turntable of the polishing device.

10. The method according to claim 9, wherein the reduction in rotational speed of the turntable is by 1 to 30 rpm.

11. The method according to claim 7, wherein the method further comprises continuing adjusting of the turntable rotational speed for each additional next consecutive batch of semiconductor wafers to be polished, in accordance with the turntable rotational speed adjustment data for the downtime determined, until the standard turntable rotational speed for the polishing device is again achieved.

12. The method according to claim 11, wherein the turntable rotational speed adjustment for the next consecutive batch of semiconductor wafers comprises reducing the turntable rotational speed from the standard turntable rotational speed, and wherein subsequent turntable rotational speed adjustments for additional next consecutive batches of semiconductor wafers comprise increasing the turntable rotational speed from the reduced turntable rotational speed toward the standard turntable rotational speed.

13. The method according to claim 7, wherein the length of downtime is from 5 minutes to 3 days.

* * * * *